US006179590B1

(12) United States Patent
Honma et al.

(10) Patent No.: US 6,179,590 B1
(45) Date of Patent: Jan. 30, 2001

(54) SCROLL FLUID APPARATUS HAVING AXIAL ADJUSTMENT MECHANISMS FOR THE SCROLLS

(75) Inventors: Toshihiro Honma; Masaki Tsuji; Toru Sato; Shinji Kawazoe, all of Yokohama (JP)

(73) Assignee: Anest Iwata Corporation, Tokyo (JP)

( * ) Notice: Under 35 U.S.C. 154(b), the term of this patent shall be extended for 0 days.

(21) Appl. No.: 09/235,399

(22) Filed: Jan. 22, 1999

Related U.S. Application Data

(62) Division of application No. 08/786,445, filed on Jan. 21, 1997, now Pat. No. 5,938,419, which is a continuation of application No. 08/784,579, filed on Jan. 17, 1997, now abandoned.

(51) Int. Cl.[7] ..... F01C 1/04; F01C 19/08

(52) U.S. Cl. ..... 418/55.1; 418/55.4; 418/57; 418/101; 418/107

(58) Field of Search ..... 418/55.1, 55.4, 418/57, 107, 101

(56) References Cited

U.S. PATENT DOCUMENTS

| | | | | |
|---|---|---|---|---|
| 2,536,292 | * | 1/1951 | Kollsman | 277/399 |
| 3,884,599 | * | 5/1975 | Young et al. | 418/188 |
| 4,065,279 | * | 12/1977 | McCullough | 418/55.4 |
| 4,178,143 | | 12/1979 | Thelen et al. | 418/57 |
| 4,575,318 | * | 3/1986 | Blain | 418/55.1 |
| 4,611,975 | * | 9/1986 | Blain | 418/57 |
| 4,781,550 | * | 11/1988 | Morishita et al. | 418/188 |
| 4,927,339 | * | 5/1990 | Riffe et al. | 418/57 |
| 5,346,374 | * | 9/1994 | Guttinger | 418/101 |
| 5,391,065 | * | 2/1995 | Wolverton et al. | 418/55.3 |

FOREIGN PATENT DOCUMENTS

| | | | | |
|---|---|---|---|---|
| 29 35 755 | * | 3/1981 | (DE) . | |
| 29 35 755 | | 3/1981 | (EP) . | |
| 747598 | * | 12/1996 | (EP) . | |
| 6-272676 | * | 9/1994 | (JP) | 418/55.1 |
| WO93/17239 | * | 9/1993 | (WO) . | |
| WO 93/17239 | | 9/1993 | (WO) . | |
| WO 95/27143 | | 10/1995 | (WO) . | |
| WO95/27143 | * | 10/1995 | (WO) . | |

* cited by examiner

*Primary Examiner*—John J. Vrablik
(74) *Attorney, Agent, or Firm*—Evenson, McKeown, Edwards & Lenahan, P.L.L.C.

(57) ABSTRACT

A scroll mounting member for mounting a drive scroll therein is secured to the left end of a drive shaft coupled to a motor. A rotary bearing is fitted on the outer periphery of the scroll mounting member, and its outer periphery is secured to a scroll housing. The scroll mounting member is disposed for rotation in the scroll housing and is secured to the drive shaft. A bearing retainer for holding the rotary bearing is mounted by bolts via a spring in a mounting portion of the scroll housing. The rotary bearing is adjustable in the thrust direction at the scroll housing. By turning bolts, the rotary bearing is either advanced in the thrust direction via the bearing retainer or retreated, via the bearing retainer and a spring, which, together with the bolts, form an adjusting device. A self-lubricating sleeve seal is axially slidably fitted in an end portion of a driven scroll mounting member. A seal plate, of a mirror-finished hard material, is secured to a seal retainer on the cylindrical end side of the sleeve seal. The sleeve seal is pushed against the seal plate by the fluid pressure so that its end is in rotating and sealing contact with the seal.

12 Claims, 8 Drawing Sheets

Fig. 2
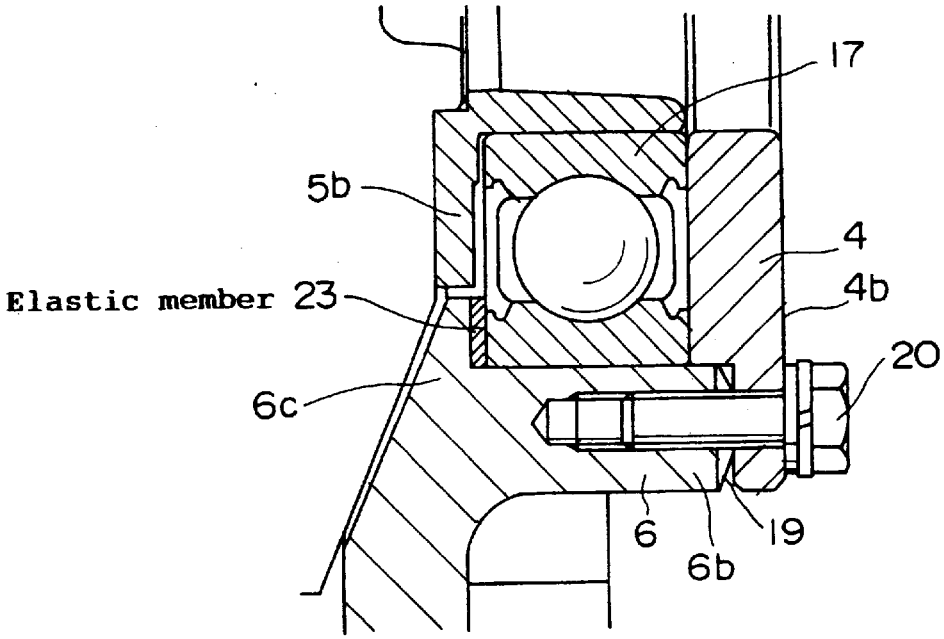
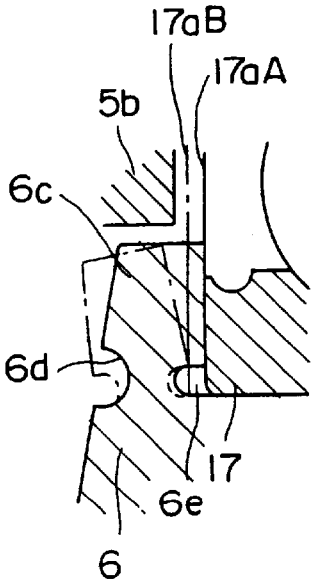
Fig. 3a
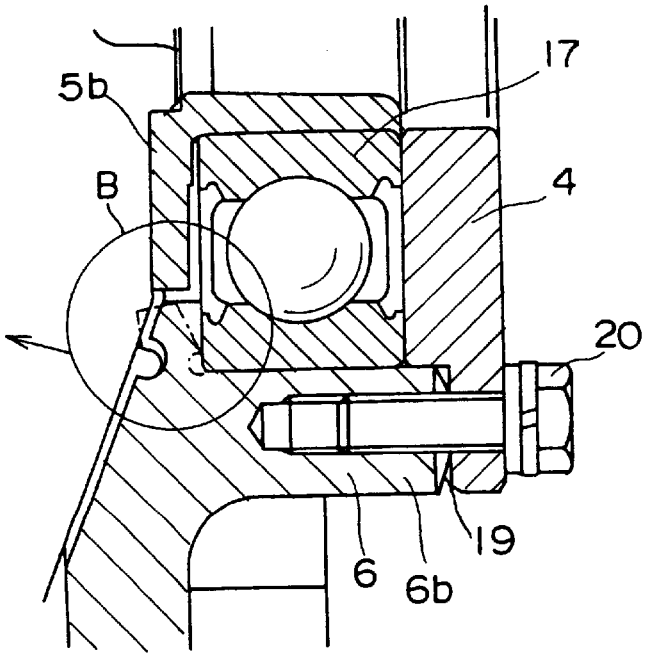
Fig. 3b

SCROLL FLUID APPARATUS HAVING AXIAL ADJUSTMENT MECHANISMS FOR THE SCROLLS

This application is a division of application Ser. No. 08/786,445, filed Jan. 21, 1997, now U.S. Pat. No. 5,938, 419, , which in turn is a continuation of application Ser. No. 08/784,579, filed Jan. 17, 1997, now abandoned.

BACKGROUND OF THE INVENTION

1. Field of the Invention

This invention relates to scroll fluid apparatuses and, more particularly, to a shaft seal structure in a scroll fluid apparatus of a rotating drive/driven scroll type comprising a drive and a driven scroll, the shaft seal structure being provided in a discharge part for discharging compressed fluid, as well as a scroll fluid apparatus in which the engagement between wraps and an opposed scroll plate is adjustable.

2. Description of the Prior Art

FIG. 11 shows a prior art scroll fluid apparatus. The apparatus comprises a stationary scroll 110 secured to an end face of a frame 140. The stationary scroll 110 has vertically an involute wrap 113 which is provided in a concave space defined by a peripheral wall 111 with a suction port 116 formed therein, and also has a discharge port 117 provided substantially at a central position for discharging compressed fluid.

In a concave space defined by the frame 140, a revolving scroll 120 is accommodated and has an involute wrap 121 formed vertically on a scroll body having an end surface in contact with an end surface of the peripheral wall 111. The involute wrap 121 has substantially the same shape as the wrap 113 of the stationary scroll 110. The wraps 113 and 121 are engaged with each other in a 180-degree out-of-phase relation to each other.

Self-lubricating seals 131 are each fitted in a concave groove formed in the end surface of each of the wraps 113 and 121 of the scrolls 110 and 120 in contact with the other scroll. The wraps 113 and 121 thus undergo sliding by lubricant-free oil. A ring-like self-lubricant free seal 132 is fitted in a concave groove formed in the end surface of the stationary scroll 110 in contact with the corresponding end surface of the revolving scroll 120, whereby the concave space defined by the peripheral wall 111 noted above is thus sealed gas-tight from the outside.

The frame 140 axially supports a drive crankshaft 141 with a pulley 142 provided at one end, and also supports three driven crankshafts 150 spaced apart at an interval of 120° with respect to the main drive shaft 141.

The crankshafts 141 and 150 have their eccentric end portions 411 and 501 supported for rotation via bearings 143 and 155 in an inner frame 125 which is integral with the revolving scroll 120.

Rotation of the drive crankshaft 141 causes revolving of the driven crankshafts 150 in correspondence to the eccentricity of the drive crankshaft 141, whereby the revolving scroll 120 undergoes revolving about the wrap center of the stationary scroll 110 with a predetermined radius of revolving while not in rotation.

In the prior art scroll fluid apparatus as described above, the parallelness and clearance of the revolving scroll 120 with respect to the stationary scroll 110 should be accurately adjusted so that the revolving scroll 120 can revolve with adequate accuracy of wrap engagement. Without these accurate adjustments, fluid may leak through sealed spaces. In addition, the wraps and the opposed sliding surfaces may be brought into contact with one another, resulting in noise generation and abnormal wear. Moreover, partial contact of the wraps is liable, thus increasing the drive power and reducing the durability of the bearings.

In the frame 140, ball bearings 151 are fitted for movement in the thrust direction on the driven crankshafts 150, which are provided at an interval of 120° with respect to the drive crankshaft 141. The position of the ball bearings 151 in the thrust direction is made adjustable by turning outside race retainers 160 in plus or minus directions. The race retainers are screwed on the driven crankshafts 150 and can be turned in either direction.

The outside race retainers 160 slightly project from the end surface of the frame 140, and can be locked by lids 146.

The driven crankshafts 150 have their eccentric portions 501 supported via bearings 155 in the inner frame 125 integral with the revolving scroll 120.

In this embodiment, the thrust displacement volume between the sliding surface 120*a* of the revolving scroll 120 and the frame end surface 140*a* is adjustable by turning the outside race retainer 160 in plus or minus directions.

In the above prior art scroll fluid apparatus, for the adjustment of thrust displacement volume between the sliding surface 120*a* of the revolving scroll 120 and the frame end surface 140*a,* the bearings 155 which are provided near the outer periphery of the revolving scroll 120 are advanced and retreated in the thrust direction by turning the outside race retainers 160 in either a plus or a minus direction. Therefore, some of the bearings 155 may be advanced or retreated excessively, while the others are advanced or retreated insufficiently, resulting in an increase of the drive power due to partial contact of wraps or durability reduction of the bearings.

OBJECT AND SUMMARY OF THE INVENTION

In view of the above background, it is an object of the invention to provide a scroll fluid apparatus, of a rotating drive/driven scroll type, which is capable of thrust adjustment of the drive scroll with a simple construction.

Another object of the invention is to improve a shaft seal structure which is provided in a discharge section for compressing and discharging fluid.

According to a first aspect of the invention, a scroll fluid apparatus of a rotating drive/driven scroll type is provided. The apparatus comprises a drive scroll plate and a driven scroll plate, these scroll plates being driven in a housing such that their wraps compress fluid and discharge the compressed fluid to the outside with their wraps. A scroll adjustment mechanism is provided for adjusting the engagement between the wraps and the opposed scroll plates.

The scroll fluid apparatus further comprises:

supporting means providing support around the central portions of the opposite side face to the wrap formative face of each scroll plate to the housing;

elastically displaceable means disposed between one of the supporting means and the housing so as to be capable of displacement in the axial direction; and adjusting means displacing one of the supporting means in the axial directions of the scroll plates.

The scroll plates are capable of being adjusted in the axial directions.

In a scroll fluid apparatus of a rotating drive/driven scroll type, drive and driven scroll plates are rotated around their supporting means. Therefore, where the thrust displacement adjustment is made at outer peripheral portions of the scroll plates, thrust displacement adjustment members should be held in the housing over the entire circumference, and complicate the construction.

However, the scroll fluid apparatus of a rotating drive/driven scroll type according to the invention is provided with drive and driven scroll plates having supporting means providing support in the above housing in the neighborhood of central portions of their side faces opposite to the wrap formative face of each scroll plate, that is, both scroll plates are supported at their central portions by the housing.

The above supporting means are displaceably adjusted in the axial direction of a scroll plate, instead of adjustable by arranging plural adjusting means provided in the outer peripheral portion of the scroll plate. Thus, the outer peripheral portion of the scroll plate is not in partial contact with the opposed scroll means and is not driven with squeak due to excessive displacement of the one of the plural adjusting means. Therefore, it is possible to improve durability.

The construction of the above scroll fluid apparatus is made simply by displacement adjustment for the above supporting means.

Since the above supporting means are displaceably adjusted, the outer peripheral portions of the scroll plate are also displaceably adjusted. Therefore, the supporting means of the central portion are not caused to be inclined diagonally and do not result in irrational friction between the supporting means and the housing portion supporting the above supporting means for the driving of the scroll plate. Durability thus can be improved.

Also, since the above supporting means are displaceably adjusted the position control with respect to a reference surface is allowed in a narrow range, centered on the supporting means, as compared to the case of an adjustable arrangement with plural adjusting means provided on the outer peripheral portion of the scroll plate. Thus, it is possible to reduce the steps of manufacture.

Moreover, where the supporting means are supported via the elastically displaceable means which is displaceable in an axial direction, the supporting means can be secured to the housing by the above elastically displaceable member after the thrust displacement adjustment of the scroll plate in the axial direction. With this arrangement, there is no noise generation based on vibration of the supporting means due to vibration of the scroll plate during driving. There is also no friction due to abnormal contact with opposite side members based on the vibration of scroll plates. Therefore, durability can be improved.

Suitably, in a scroll fluid apparatus of a rotating drive/driven scroll type, a dust seal housing is provided and supports the neighborhood of the outer periphery on the formative face side of each of the scroll plates.

With this arrangement, the gap or distance between both scroll plates is defined by the dust seal housing and can be easily adjusted through thrust displacement adjustment of the supporting means in the central portion of the scroll plates.

The dust seal housing further positions outer peripheral portions of the both scroll plates to eliminate fabrication errors, thus eliminating axial deviations of the scroll outer peripheral portions during driving. It is thus possible to prevent otherwise possible vibrations and durability reduction.

According to a second aspect of the invention, a scroll fluid apparatus of rotating drive/driven scroll type is provided and comprises a drive scroll and a driven scroll driven in a housing such that their wraps compress fluid and discharge the compressed fluid to the outside.

An intermediate seal member has a compressed fluid passage provided between a housing discharge opening for discharging compressed fluid to the outside of housing and a scroll plate discharge exit for discharging compressed fluid.

The intermediate seal member has one end portion capable of being displaced along the compressed fluid passage and in gas-tight contact with the scroll discharge exit. The other end portion is faced with the edge of the housing discharge opening.

The other end portion of the intermediate seal member and the housing discharge opening edge are held in gas-tight contact with each other by the pressure of the compressed fluid.

It is a further effective means according to the invention to provide the discharge opening in a seal retainer which is detachably mounted in the housing member having a passage cooling the scroll plate.

Specifically, as shown in FIG. 4, according to the second aspect of the invention, compressed fluid to be discharged to the outside of the housing should be sealed by an intermediate seal member (i.e., a seal sleeve plate 101 and a seal plate 102) which is provided between a discharge opening 12*a,* through which compressed fluid in the housing is discharged, and a discharge exit 14*e,* through which compressed fluid in the scroll plates is discharged.

One end portion of the intermediate seal member is in gas-tight contact with the discharge exit 14*e* while being capable of being displaced along the compressed fluid passage.

The other end portion of the intermediate seal member faces the edge of the discharge opening 12*a*. The pressure of the compressed fluid serves as a sealing force to hold the other end portion (on the side of the seal plate 102) of the intermediate seal member and the discharge opening edge (i.e. the seal plate 102) in gas-tight contact with each other.

Therefore, the compressed fluid passage and the cooling air circulation passage 10 are sealed and are gas-tight with each other. Thus, the compressed fluid to be discharged to the outside of the housing should be prevented from entering in a cooling air circulation passage 10*a*.

Wear of the seal sleeve 101 or the seal plate 120 thus gives rise to no problem, because the sleeve seal 101 is pushed against the seal plate 102 by a force provided by compressed fluid in the discharge direction thereof. Disability of sealing due to gas-tight state deterioration thus seldom occurs.

Where, in a scroll fluid apparatus of rotating drive/driven type, the discharge opening is provided in a seal retainer 103 capable of being detached in the member (the mounting member cover) 11, it is possible to replace the sleeve seal 101 or the seal plate 102 when worn as desired.

The intermediate seal member may include a seal plate having a central opening, which is disposed on the discharge opening side for discharging compressed fluid to the outside of the housing, and a sleeve seal which is disposed on the scroll plate compressed fluid discharge exit side, so that its discharge side of the intermediate seal member is in communication with the housing discharge opening for discharging compressed fluid.

At least one of the contact surfaces of the seal plate and sleeve seal plate in contact with each other may be a curved surface.

The sleeve seal plate may be made of a self-lubricating material.

The seal plate may be made of a highly wear-resistant material.

A scroll mounting member having an inner passage may be provided such that an end portion is connected to a compressed fluid discharge exit of the driven scroll. A sleeve seal made of a resin may be axially slidably fitted in another end portion of the scroll mounting member, and a seal plate made of a wear-resistant material and having a central opening may be disposed in the discharge opening side of the housing surrounding the driven scroll such that it faces the above sleeve seal. With this construction, the sleeve seal is always pushed against the seal plate by the pressure of compressed fluid being discharged, while its rotating end face is in sliding and sealing contact with the seal.

The one end of a sleeve seal made of a resin having a compressed fluid discharge passage may be axially slidably fitted in a discharge opening side recess for discharging the compressed fluid to the outside of the housing surrounding the driven scroll such that it faces the discharge opening.

One end of scroll mounting member having an inner passage may be provided such that an end portion is connected to a compressed fluid discharge exit of the driven scroll.

The other end of the scroll is axially slidably fitted in the discharge passage of the sleeve seal via a seal plate made of a wear-resistant material and, with a central opening, may be axially slidably fitted in the discharge passage of the sleeve seal.

With this construction, the sleeve seal is always pushed against the seal plate by the pressure of compressed fluid being discharged, while its rotating end face is in sliding contact with the seal.

The sleeve seal may be made of a synthetic resin which has such a heat resistance that it can withstand an increased temperature due to heat of fluid compression, as well as a self-lubricating property of the sliding surface.

It is a further effective means according to the second aspect of the invention to have the above seal plate form a mirror-finished sliding surface on a ceramic or like material which has been surface hardening treated.

This means is constructed with an intermediate seal comprising a seal plate 102, which is disposed on the discharge opening side thereof for discharging compressed fluid to the outside of housing and having a central opening, and a sleeve seal 101 disposed in a scroll plate on the compressed fluid discharge exit side thereof.

A seal retainer 103 is detachably disposed in the mounting member cover 11, the above sleeve seal 101 is made of a self-lubricating material and the above seal plate 102 is made of a highly wear-resistant material. In this way, it is possible to obtain lubrication-free operation of the sleeve seal 101 rotating with the driven scroll and readily replace the sleeve seal 101 as desired.

Where at least one of the contact surfaces of the seal 102 and the sleeve seal 101 in contact with each other is formed as a curved surface, the two contact surfaces can readily become intimate due to contact with each other, thus readily forming a gas-tight state of seal.

Since the discharged compressed gas has a high temperature, the sleeve seal 101 should be made of a heat-resistant material capable of withstanding the elevated temperature brought about by the heat of fluid compression. The seal plate 102 is desirably secured to the seal retainer 103. This means that the seal plate is desirably made of a ceramic or like material, which has been surface treated and has a mirror-finished sliding surface.

BRIEF DESCRIPTION OF THE DRAWINGS

FIG. 2 is an enlarged-scale view showing part A in FIG. 1, showing an example of elastically displaceable means for supporting a bearing;

FIGS. 3*a* and 3*b* are views showing a different example of the elastically displaceable means as the bearing support;

DETAILED DESCRIPTION OF THE PREFERRED EMBODIMENTS

Embodiments of the invention will now be described with reference to the drawings. Except as otherwise specified, the sizes, materials, shapes and relative dispositions of parts described in the embodiments have no sense of limiting the scope of the invention, but are merely exemplary.

Figure 1:
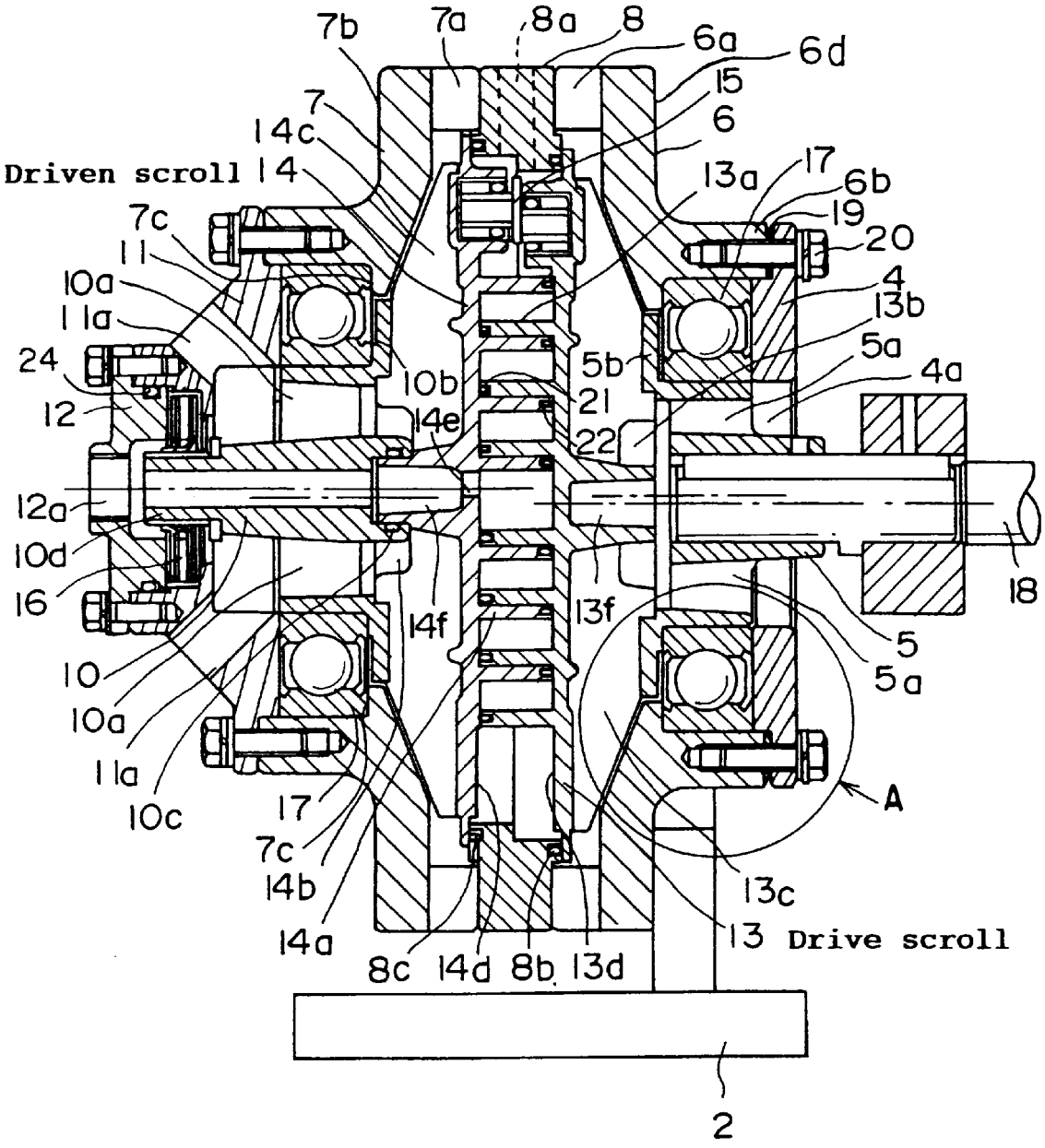
FIG. 1 is a sectional view showing an embodiment of the scroll fluid apparatus of rotating drive/driven scroll type according to the invention.

Referring to FIG. 1, a scroll mounting member 5 for mounting a drive scroll 13, to be described later, is secured to the left end of a drive shaft 18 which is coupled to a motor (not shown)

The scroll mounting member 5 is mushroom-like in shape and has a communication bore which extends through a stem portion and a flaring portion of the member 5 and is fitted on the drive shaft 18. The member 5 also has three radially spaced-apart mounting portions 5*b* formed on the outer side of the flaring portion, the mounting portions 5*b* having three holes 5*a* through which cooling air flows.

A rotary bearing 17 is fitted on the outer periphery of the flaring portion of the scroll mounting member 5. The rotary bearing 17 has its outer periphery secured to a scroll housing 6, which is secured to a base 2. The scroll mounting member 5 is disposed for rotation in the scroll housing 6 in a state secured to the drive shaft 18.

The scroll housing 6 has a plurality of holes 6*a* formed in its peripheral wall for discharging air having cooled the drive scroll 13.

The drive scroll 13 is disc-like and has fan blades 13*c* formed on its back side and an involute wrap 13*a* formed on its front sliding surface 13*d*. The wrap 13*a* has a tip groove formed in its tip facing the opposed sliding surface, and a tip seal 21 of a self-lubricating material such as a fluorine-based resin is fitted in the tip groove.

The drive scroll 13 specifically has three fan blades formed on its back side at a radial interval of 120°. The scroll mounting member 5 has its mounting portions 5*b* mounted on large thickness portions of the three fan blades 13*c*.

Three revolving mechanisms 15 are provided on the drive scroll 13 near the edge of the sliding surface 13*d* with the wrap 13*a* thereon at a circumferential interval of 120°.

Via the revolving mechanisms 15, a driven scroll 14 is connected with above drive scroll, which has a wrap 14*a* engaging with the wrap 13*a* and having a wrap wall.

The wrap 14*a* disposed in the sliding surface 14*d* of the driven scroll 14 is opposite in involute shape to the wrap 13*a* of the drive scroll 13. The driven scroll 14 has a hole 14*e*, which is concentric with the axis of its rotation and communicates the sliding surface 14*d* with the outside for discharging compressed fluid to the outside. For the rest, the driven scroll 14 has the same dimensions and shape as the drive scroll 13.

The driven scroll 14 further has a cylindrical passage-forming portion 14*f*, which surrounds the opening of the hole 14*e* and has an end portion fitted in an end portion 10*c* of a communication bore of a scroll mounting member 10 to be described later.

The wrap 14*a* noted above has a tip groove formed in its tip facing the opposed sliding surface, and a tip seal 22 of a self-lubricating material such as a fluorine-based resin is fitted in the tip groove.

The drive scroll 13 has a passage 13*f* like the passage 14*f*, but this passage 13*f* is not used because no hole like the hole for discharging compressed fluid to the outside is provided to the outside in the driven scroll.

Like the drive scroll 13, the driven scroll 14 has three fan blades 14*c* provided on the back side at radial intervals of 120°, and mounting portions of the scroll mounting member 10 to be described later are mounted on large thickness portions of the fan blades 14*c*.

Three revolving mechanisms 15 are provided on the driven scroll 14 near the edge of the sliding surface 14*d* at a circumferential interval of 120°. Via these revolving mechanisms 15, the driven scroll 14 is revolved about an axis of rotation eccentric with the axis of rotation of the drive scroll 13.

A dust seal housing 8 is provided between the sliding surfaces 13*d* and 14*d* of the drive and driven scrolls 13 and 14 such that it surrounds and forms a predetermined space from the outer wall of wraps with the wraps of the drive/driven scrolls.

The dust seal housing 8 is a doughnut-like die-casting having a predetermined thickness. It forms an outer peripheral wall of the apparatus and has a fluid suction port 8*a*. It has dust seals 8*b* and 8*c* of a self-lubricating material such as a fluorine-based resin. The dust seals 8*b* and 8*c* are located at positions corresponding to the neighborhood of the outer periphery of the sliding surfaces 13*d* and 14*d* of the drive and driven scrolls 13 and 14.

Therefore, the dust housing surface is in frictional contact with the drive and driven scrolls 13 and 14 with dust seals 8*b* and 8*c* between both scrolls.

Therefore, the dust intrusion into the housing is prevented with this construction and it is possible to both perfect the dust seal and to define the scroll distance therebetween.

The dust seal housing 8 is held at a position (not shown) in the neighborhood of its outer periphery of dust seal housing 8 and sandwiched between the scroll housing 6 and a scroll housing 7 to be described later.

The scroll mounting member 10, which is mounted on large thickness portions of the fan blades 14*c* provided on the back side of the driven scroll 14, is substantially mushroom-like in shape, and has a communication bore extending through its stem portion and flaring portion for discharging compressed fluid to the outside. The driven scroll 14 has a passage-forming portion 14*f*, which is fitted in an end portion 10*c* of the communication bore. The driven scroll 14 is secured to the scroll mounting member 10*b*. The scroll mounting member 10 has three holes 10*a*, which are formed in the flaring portion other than the mounting portions for passing cooling air.

A rotary bearing 17 is fitted on the flaring portion of the scroll mounting portion 10, and its outer periphery is secured to the scroll housing 7.

The dust seal housing 8 is held at a position (not shown) near the outer periphery sandwiched between scroll housing 6 and scroll housing 7. The scroll mounting member 10 is disposed for rotation in the scroll housing 7 with the driven scroll 14 secured to it.

The peripheral wall of the scroll housing 7 has a hole 7*a*, through which air having cooled the driven scroll 14 is released to the outside.

A scroll mounting member cover 11 is mounted on the scroll housing 7 so as to cover the flaring portion of the driven scroll mounting member 10. A seal member 16 having an opening hole in the central portion is disposed with the opening hole surrounding the discharge opening 10*d* of above mounting member 10.

The seal retainer secured to the seal member 16 is connected to the scroll mounting member cover 11, through which discharged fluid is prevented from flowing through the outer periphery of discharged exit 10*d* to the back side of the driven scroll 14.

The seal retainer 12 has an opening 12*a* for discharging compressed fluid.

The scroll mounting member cover 11 has a through opening 11*a*. Air entering from the through hole 11*a* flows through an opening 10*a* in the scroll mounting member 10 to the back side of the driven scroll 14, and can be released by the fan blades 14*c* through the opening 7*a* in the scroll housing 7 to the outside.

The rotary bearing 17 is pushed by a bearing retainer 4, which is mounted in a mounting portion 6*b* of the scroll housing 6 via a spring 19 by bolts 20 such that it is adjustable in thrust directions.

By turning the bolts 20, the rotary bearing 17 can be advanced and retreated in the thrust directions via bearing retainer 4. Adjusting means is constituted by the bearing retainer 4, bolts 20, etc.

The operation of the embodiment having the above construction will now be described.

Referring to FIG. 1, rotation of the drive shaft 18 causes fluid to be sucked through the suction port 8*a* provided in the dust seal housing 8, causing fluid in the space formed by the wraps 13*a* and 14*a* and the dust seal housing 8 to be taken and progressively compressed by the wraps 13*a* and 14*a*, and discharged through the discharge port 14*e* provided in the driven scroll 14.

This operation is performed continuously. During this operation, air is caused to flow through the opening 4*a* in the bearing retainer 4, and fed through the opening 5*a* in the scroll mounting member 5 and the concave space 13*b* in the drive scroll 13 to cool the scroll plate. The air having cooled the drive scroll 13 is released through the opening 6*a* in the scroll housing 6 to the outside with the rotation of the fan blades 13*c*.

Likewise, air is caused to flow through the hole 11*a* in the scroll mounting member cover 11, and fed through the opening 10*a* of the scroll mounting member 10 and the space 14*b* in the driven scroll 14 to cool the scroll plate. The air having cooled the scroll is released through the opening 7*a* in the scroll housing 7 to the outside with the rotation of the fan blades 14*c*.

The surface 7*b* of the scroll housing 7 and the stepped portion 7*c* of the rotary bearing 17 can be formed with considerably high accuracy. High accuracy can be further obtained with respect to the thickness of the mounting portion 10*b* of the scroll mounting member 10 for mounting the scroll plate and the dimension between the sliding surface 14*d* of the driven scroll and the scroll mounting portion 10*b*.

The distance between the scrolls thus can be adjusted by causing advancement and retreat of the rotary bearing 17 of the drive scroll 13 in the thrust directions with the surface 7*b* of the scroll housing 7 as a reference and securing the bearing retainer 4 in a suitable position by the bolts 20.

The adjusting operation will now be described with reference to FIG. 2. Referring to the figure, the bearing retainer 4 is tentatively set in the mounting portion 6*b* of scroll housing 6 by the bolts 20, and the back surface 4*b* of the bearing retainer 4 is pushed with a predetermined pressure.

The bearing retainer 4 causes flexing of the spring 19 to cause flexing of elastically displaceable means via rotary bearing 17, which is constituted by an elastic member 23, such as a rubber piece, a washer, etc., and causes displacement of the drive scroll 13 to the left via the scroll mounting member 5. (FIG. 1)

When the bearing retainer 4 is stopped, it is secured in this position by the bolts 20. At this position, the tip seals 21 and 22 fitted in the tip grooves of the wraps 13*a* and 14*a* become well intimate with the tip grooves. In this way, floating of the tip seals from the tip grooves can be precluded.

When an excessive pushing force is applied to it, the bearing retainer 4 bears an excessive load at its stopped position, thus reducing the durability and economy. In such a case, the bearing retainer 4 should be returned slightly (for instance by 0.2 to 0.3 mm) after it has been stopped.

FIGS. 3*a* and 3*b* show a different example of the elastically displaceable means. This means is provided between bearing and scroll housing. Specifically, a stopped portion 6*c* of the scroll housing 6, in which the rotary bearing 17 is supported, has recesses 6*d* and 6*e* imparting elasticity to it.

By pushing the bearing retainer 4 to the left, the stepped portion 6*c* is bent as shown by the phantom line, and line 17*a*A of contact between the rotary bearing 17 and the stepped portion 6*c* is shifted to the left as shown by the phantom line 17*a*B. The distance between the scrolls can be adjusted in this way.

Figure 12:
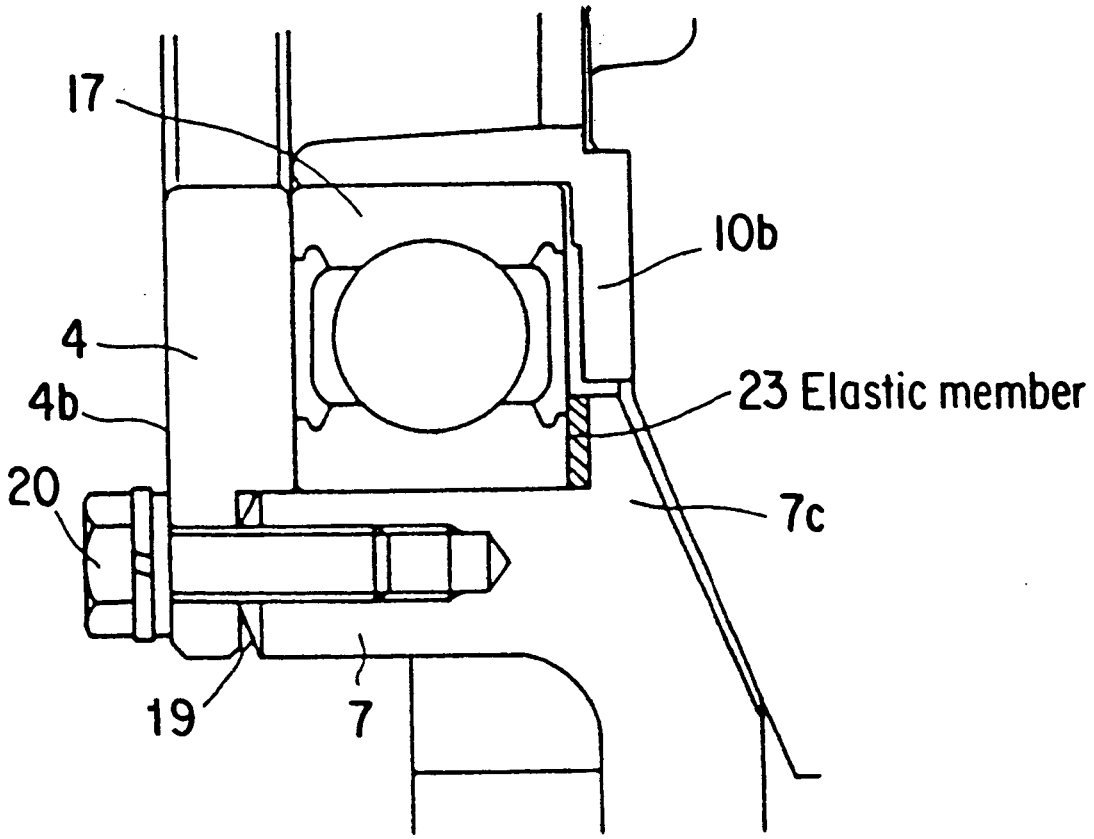
FIG. 12 is a partial view of an alternate embodiment of the invention with an adjustable driven scroll.

While the above example of elastically displaceable means is provided between the drive scroll bearing and the drive scroll housing, this is in no sense limiting. It is, of course, possible as well to provide an elastically displaceable member on the driven scroll side, as shown in FIG. 12.

In this case, it is possible to secure the drive scroll side bearing 17 to the housing 6 and provide a scroll mounting member cover 11, instead of the bearing retainer 4, for axial adjustment by the bolts 20. The distance between the two scrolls can be adjusted by advancing or retreating the rotary bearing 17 of the driven scroll 14 in the thrust direction with the surface 6*d* of the scroll housing 6 as a reference and securing the scroll mounting member cover 11 in a suitable position by the bolts 20.

Figure 4:
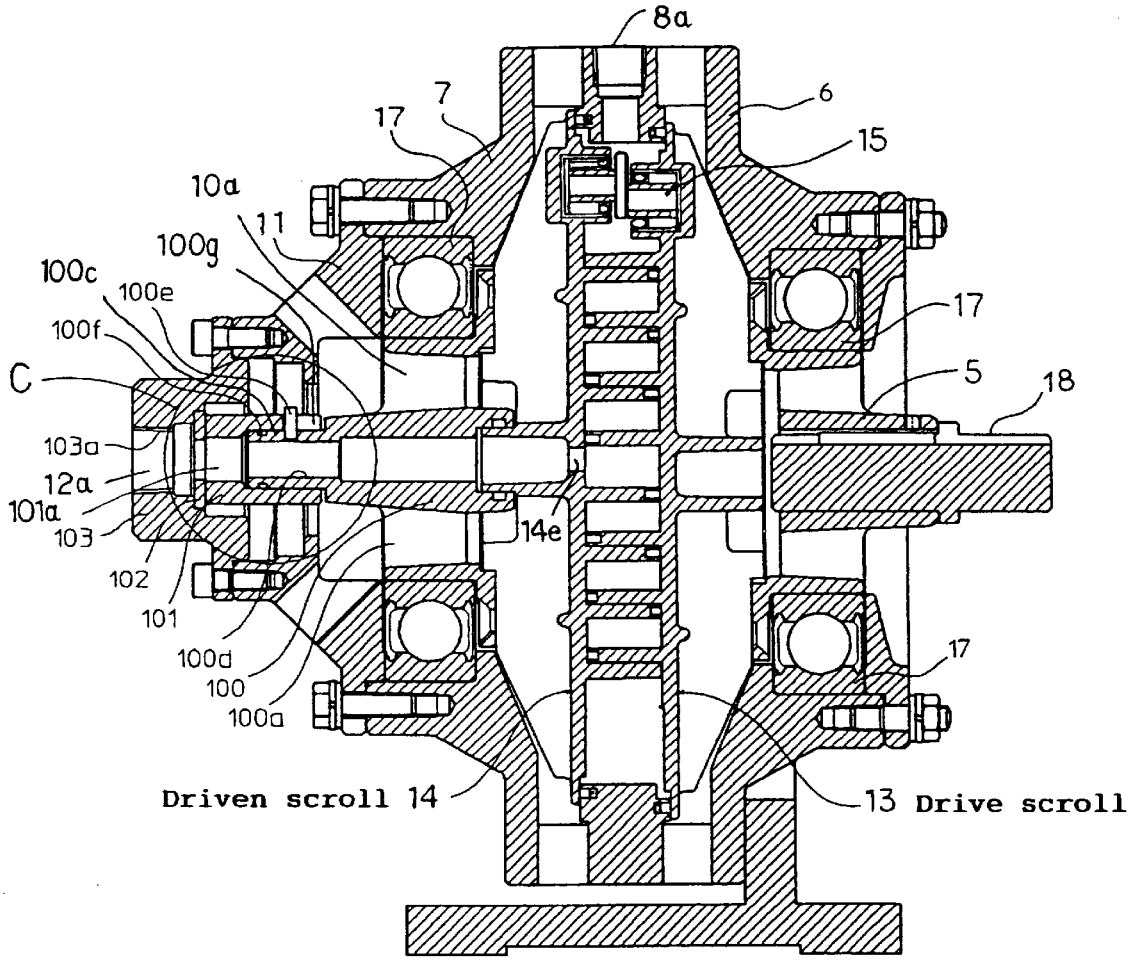
FIG. 4 is a sectional view showing a shaft seal structure embodying the invention.
Figure 5:
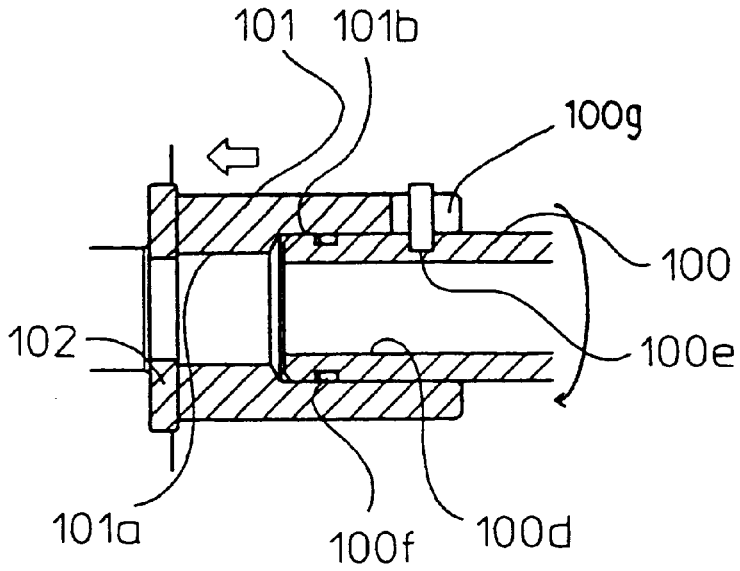
FIG. 5 is an enlarged-scale view showing part C shown in FIG. 4.

FIG. 4 is a sectional view showing an example of shaft seal structure in the scroll fluid apparatus according to the invention. FIG. 5 is an enlarged-scale sectional view showing part C shown in FIG. 4.

Air sucked through the suction port 8*a* is compressed in sealed spaces which are formed by the driven scroll 14 revolved relative to the drive scroll 13 by the revolving mechanisms 15.

The air is progressively reduced in volume and discharged through the discharge port 14*e* provided in the driven scroll 14 at the center thereof.

The discharged compressed air is discharged from the discharge opening 12*a* to the outside through the central hole of the scroll mounting member 100 which is connected frictionally and gas-tight with discharged exit 14*e* of the driven scroll.

A portion 100*c* of the scroll mounting member 100, which is fitted in the cylindrical sleeve seal 101 made of a resin, has an O-ring groove 100*f* in which an O-ring is fitted in gas-tight fitting of the fitted portion 100*c*.

A pin 100*e* is fitted in the outer periphery of the fitted portion 100*c* to cause rotation of the sleeve seal 101 in unison with the scroll mounting member 100.

A seal plate 102 is secured to the seal retainer 103 having the above discharge opening 12*a* so that it is in rotating and sealing contact with the corresponding cylindrical end of the sleeve seal 101. The seal retainer 103 is bolted to the scroll mounting cover 11.

Referring to FIG. 5, the sleeve seal 101 is made of a synthetic resin which is self-lubricating and capable of withstanding increased temperatures due to heat of compression, for instance those composed of PTFE (polytetrafluoroethylene), PPS (polyethylene sulfide), PEEK (polyether etherketone) etc., and containing fillers for improving the lubricating property and durability based an molybdenum dioxide.

The cylindrical sleeve seal 101 has at its right end a rectangular notch 100*g* by which the edge of the cylindrical end portion is opened.

A pin 100*e* fitted in the outer periphery of the scroll mounting member 100 is inserted in the notch 100*g*.

The bore of the sleeve seal 101 has a discharge end portion 101*a* and a fitted portion 101*b*, the portion 101*b* being smaller in diameter than the portion 101*a*. Discharge fluid pressure is applied to the diameter difference area, thus always providing a force tending to push the sleeve seal 101 to the seal plate 102.

The diameter of the discharge end portion 101*a* is set to an adequate value to obtain an adequate sliding surface pressure as the pushing force in dependence on a predetermined discharge pressure, etc. of the scroll fluid apparatus.

With this construction, wear of the sliding end surface of the sleeve seal 101 which seal plate 102 is made up for by displacement of the fitted portion 101*b* of the sleeve seal 101 in the pushing direction to provide the pushing force corresponding to the discharge pressure. Long durability of seal is thus obtainable.

The seal plate 102 is made of a ceramic or steel, with its sliding surface hardened by annealing of steel, hard plating on metal, etc. The sliding surface is hard surface finished and is highly wear-resistant. The seal 102 is secured to the to the seal retainer 103 by pressure fitting, driving or using an adhesive.

The seal plate 102 is thus hardly worn although the sleeve seal 101 is worn out. The seal 102 has a diameter greater than the diameter of the sleeve seal 101 to allow a slight deviation during assembling of the scroll mounting member 100.

Figure 6:
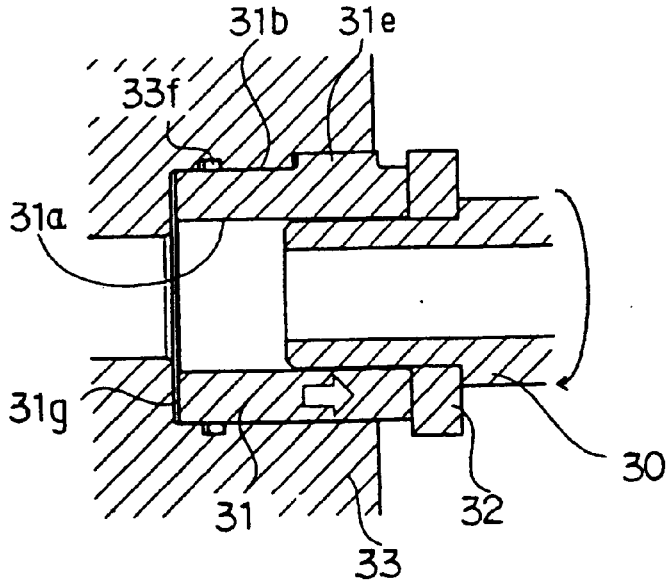
FIG. 6 is a view showing a different shaft seal structure.

FIG. 6 is an enlarged-scale sectional view showing a different example of the part C shown in FIG. 4. The scroll mounting member 30 of the driven scroll 14 is fitted in the sleeve seal 31, and the seal plate 32 is secured by pressure fitting to the driven scroll mounting member 30 for rotation in unison therewith.

The seal retainer 33 has an anti-rotation key groove, and the sleeve seal 31 has a raised key convex portion 31*e* which is redundantly fitted in the key groove for keying in order to stop rotation. The seal sleeve 31 is inserted slidably in the direction of central axis of the mounting member 30.

The pressure of compressed fluid discharged in the scroll fluid apparatus is applied to the area corresponding to the difference between the outer and inner diameters 31*b* and 31*a* of the sleeve seal 31 from a gap 31*g* adjacent the left end of seal sleeve 31 which is contacted to push the polishing surface of seal plate 32.

Thus, the seal retainer 33 has the O-ring groove 33*f*, in which the O-ring is fitted to block external air.

In this system, the sleeve seal 31 is not rotated relative to the seal retainer 33 while being axially slidable, and the sleeve seal plate 32 instead is secured to and rotatable in unison with the scroll mounting member 30. The same functions and effects as described before in connection with FIG. 5 are obtainable.

FIGS. 7 to 10 show further examples of the part C shown in FIG. 4.

Figure 7:
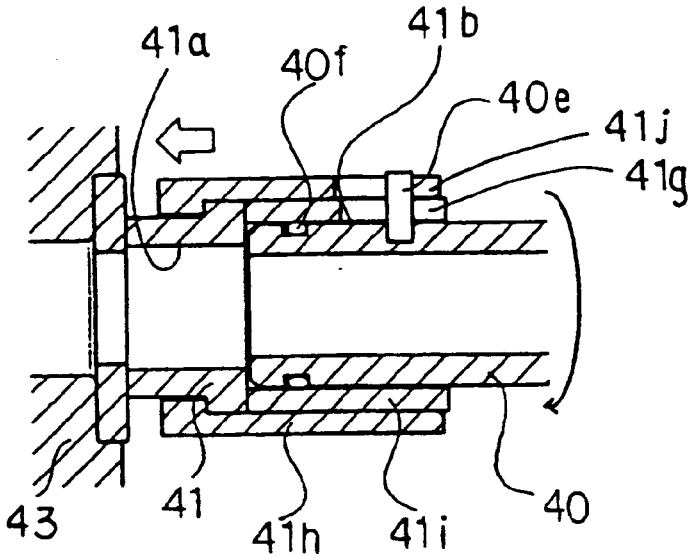
FIG. 7 is a view showing a further shaft seal structure.

The example shown in FIG. 7 seeks to reduce the material of the of the sleeve seal 41. The seal plate is designated at 43. The sleeve seal 41 has a portion held between seal holding members 41*h* and 41*i*. The fitted portion 41*b* of the scroll mounting member and the and the sleeve seal 41*a* have different inner diameters, causing the seal 43 to be pushed by fluid pressure.

The element designated 40*e* is a pin which is fitted in the mounting member 40, 40*b* is O-ring groove, 41*g* and 41*j* show rectangular groove holes which function the same as that explained in FIG. 5.

Figure 8:
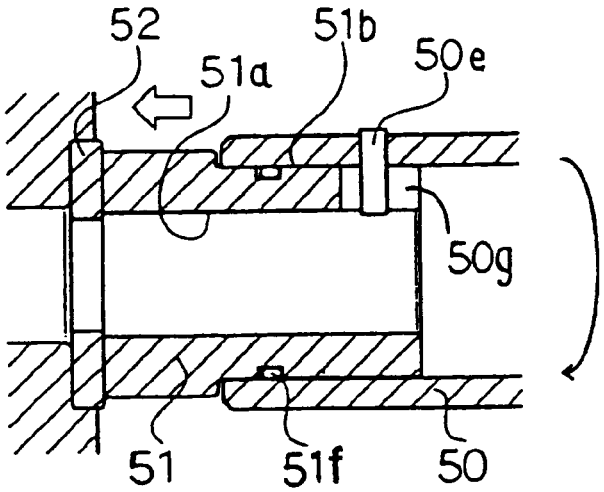
FIG. 8 is a view showing a still further shaft seal structure.

The example shown in FIG. 8 is a system in which a fitted portion 51*b* of the sleeve seal 51 is fitted in the driven scroll mounting member 50. The sleeve seal 51 has an O-ring groove 51*f* in which the O-ring is fitted.

The sleeve seal 51 is pushed against the seal plate 52 by the pressure applied to the area corresponding to the difference between the outer and inner diameters 51*b* and 51*a* of the sleeve seal 51.

50*g* is a rectangular groove hole and 50*e* is a pin which is mounted in the above groove hole 50*g*. The same functions and effects as described before in connection with FIG. 5 are obtainable.

Figure 9:
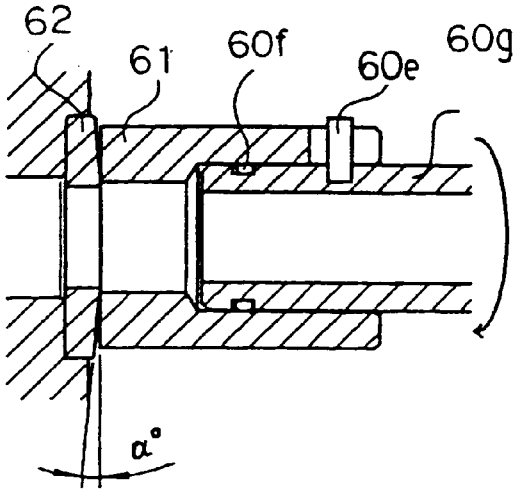
FIG. 9 is a view showing a yet further shaft seal structure.

The example shown in FIG. 9 is the same as the structure shown in FIG. 5 insofar as the anti-rotation pin 60*e* inserted in the driven scroll mounting member 60, the O-ring groove 60*f* and the O-ring are concerned. In this example, the surface of the seal plate 62 in frictional contact with the sleeve seal 61 has a slight taper with an angle $\alpha$. The area of the frictional contact surfaces is thus reduced to let these surfaces more quickly become intimate with each other.

Figure 10:
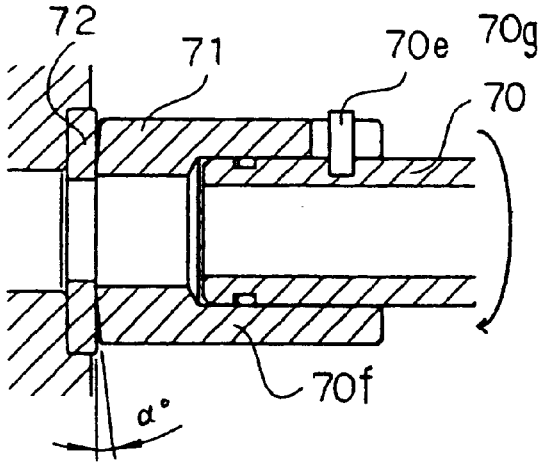
FIG. 10 is a view showing a yet another shaft seal structure.
Figure 11:
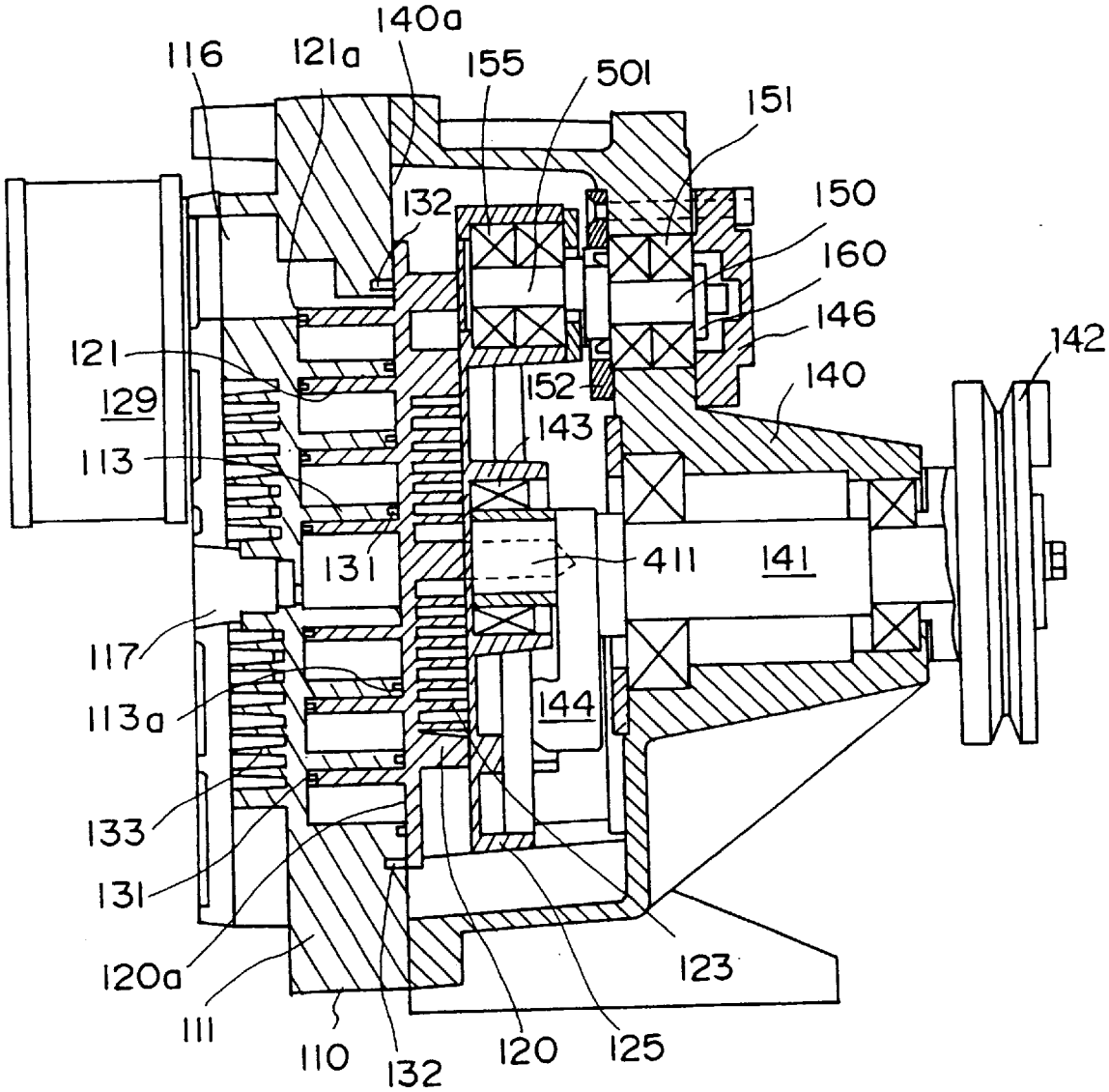
Fig. 11 PRIOR ART
FIG. 11 is a sectional view showing a prior art scroll fluid apparatus.

The example shown in FIG. 10 is the same as the structure shown in FIG. 5 insofar as the anti-rotation pin 70*e* inserted in the driven scroll mounting member 70, the O-ring groove 70*f* and the O-ring are concerned. In this example, unlike the example shown in FIG. 5, the surface of the sleeve seal 71 in frictional contact with the seal plate 72 has a slight taper with an angle $\alpha$. The same functions and effects as in the case of FIG. 5 are obtainable.

The sleeve seal 101 has a rectangular notch 100*g* open at an end, so that it can be readily fitted in an inserted portion 100*c* of the scroll mounting portion 100.

Since the discharge port seal is in surface contact and the sleeve seal 101 has a smaller inner diameter than the inner diameter of the seal plate 102, a slight deviation from the axis in assembling has no adverse effects on the discharge port seal.

The pushing force with which to have the end surface of the sleeve seal 101 in frictional and sealing contact, is determined mainly by the diameter of the discharge side hole 101*a* of the sleeve seal 101 and the discharge pressure of the scroll fluid apparatus, and the diameter of the discharge side hole 101 *a* is set to an adequate value in dependence on the kind of the apparatus.

In the embodiment having the construction as described above, the following advantages are obtainable. A nearly central portion of the drive scroll on the side thereof opposite the wrap is supported in the scroll housing via the supporting means, which is position adjustable displaceably in the axial direction of the scroll. Therefore, it would not be necessary to adjust a plurality of adjusting means provided near scroll plate outer periphery. The outer periphery of the scroll plate thus would not be in partial contact and driven in squeaking contact with the opposed scroll due to excessive displacement of one of the plural adjusting means. It is thus possible to improve the durability.

The central portion of scroll plate is held by supporting means that is supported in the housing, by which the supporting means are displaceably adjusted. Therefore, the supporting means are inclined or slanted by the displacement adjustment for the outer peripheral portion of scroll plate. The driving of a scroll plate between the supporting means and the housing portion supported by the supporting means does not cause any unjustifiable friction. Therefore, durability is improved.

The displaceable adjustment of the supporting means, supporting the central portion of the scroll, allows the position control with respect to a reference surface in a narrow range centered on the supporting means as compared to adjusting a plurality of adjusting means provided near the outer periphery of scroll plate. It is thus possible to reduce the steps of manufacture.

Furthermore, the scroll fluid apparatus of a rotating drive/driven type comprises the drive and driven scrolls via their supporting means. That is, both the drive and driven scroll plates are rotated about their supporting means.

Therefore, like the case in which thrust displacement adjustment is made at the outer peripheral portion of a scroll plate, the displacement adjusting member should not be held in the housing over the entire circumference. Instead, the supporting means should be displaceably adjusted at the central portion of the scroll plate so that the construction is made simply.

The dust seal housing, which supports the outer peripheral neighborhood of the wrap formative face side of each of the scroll plates, defines the distance between the both scroll plates by the above dust seal housing, thus permitting adjustment of the central portions of the scrolls with the supporting means. It is thus possible to easily adjust the distance between the scroll plates.

The dust seal housing also positions the outer periphery of the both scroll plates. It is thus possible to prevent deviations of the scroll outer periphery in the axial direction during driving due to fabrication errors or like causes. Because of eliminating generation of vibrations, the durability is improved.

Since the supporting means are supported in the elastically displaceable means displaceable in the axial direction they can be secured to the scroll housings by the elastically displaceable means after displaceable adjustment of the scroll plates. It is thus possible to prevent some noise generation thereof via vibrations of the supporting means due to vibrations of the scroll plates during driving thereof. It is also possible to prevent friction via abnormal engagement with the opposite side member between the scrolls due to vibrations thereof. Thus, durability is improved.

In preferred embodiments, the intermediate seal member having the inner compressed fluid passage is disposed between the discharge opening for discharging compressed fluid to the outside of the housing and the discharge exit for discharging compressed fluid of scroll plates.

One end of the intermediate seal member is in gas-tight contact with the above compressed fluid discharging exit so as to be movable in the extending direction of the above compressed fluid passage.

Moreover, the other end of the intermediate seal member is disposed facing the edge of the discharge opening, and the pressure of the compressed fluid serves to have the other end of the intermediate seal member and the edge of the discharge opening in gas-tight contact with each other.

Wear of the sleeve seal or the seal plate thus gives rise to no problem, because the sleeve seal member is pushed against the seal plate face by a force provided by compressed fluid provided in the discharge direction thereof. Disability of sealing due to deterioration in a gas-tight state thus seldom occurs.

The compressed fluid to be discharged to the outside of the housing should be prevented from entering the passage for circulating cooling air due to sealing with the intermediate seal member.

Where the above discharge opening is disposed in the seal retainer which is detachably mounted in the member having passage cooled the scroll plate, the above seal member or seal plate can be readily replaced as desired.

By preparing the sleeve seal with a self-lubricating material and preparing the seal plate with a highly wear-resistant material, it is possible to obtain lubricant-free oil operation of the sleeve seal which rotates in unison with the driven scroll.

Moreover, where at least one of the contact surfaces of the seal plate and the sleeve seal in contact with each other is formed as curved surface, the two contact surfaces can readily become intimate due to a small contact surface size, thus readily forming a gas tight state of seal.

As has been described in the foregoing, according to the invention the distance and the state of engagement between the two scrolls are adjustable with a simple construction.

The thrust adjustment of scroll is also adjustable after the above drive scroll has been assembled in its housing, which permits rough setting of the machining and assembling accuracies of various parts related to the thrust adjustment. This leads to a reduction of the machining and assembling costs.

Simplification of the construction of the sleeve seal can be obtained with the shaft seal structure which prevents leaking to the scroll back side of discharged fluid by the sleeve seal member slidably fitted in the driven scroll mounting member and the seal plate for receiving the sleeve seal member pushed by the pressure of fluid being discharged. A sleeve seal which is stable and durable for long time is thus obtainable. The shaft seal structure also can be easily replaced during assembling and maintenance.

With a construction in which the seal plate and the sleeve seal are in surface contact with each other and also the central opening of seal plate is smaller in diameter than the discharge fluid passage of sleeve seal, it is possible to facilitate assembling of the scroll fluid apparatus and obtain a shaft seal structure which is not influenced by a eccentric deviation of the driven scroll mounting member during assembling.

What is claimed is:

1. A scroll fluid apparatus of a rotating drive/driven scroll type comprising:

a drive scroll and a driven scroll, the drive and driven scrolls including opposing scroll plates and being driven in a respective housing such that wraps thereof compress fluid and discharge compressed fluid to the outside, a scroll adjustment mechanism for adjusting engagement between the wraps and the opposing scroll plates, the drive scroll being mounted on a scroll mounting member, which in turn is secured to a rotary shaft, a bearing fitted to the outer periphery of the scroll mounting member, the outer periphery of the bearing being secured to the housing of the drive scroll so that the scroll mounting member rotates together with the rotary shaft and the drive scroll, and a bearing retainer secured to the housing of the drive scroll which urges the bearing against the housing in a thrust direction, wherein the housing of the drive scroll is disposed between the bearing retainer and a rear surface of the drive scroll plate and is provided with an elastically displaceable member such that urging the bearing against the housing of the drive scroll elastically displaces the member in a thrust direction, and the drive scroll is made adjustable in the thrust direction.

2. A scroll fluid apparatus according to claim 1, wherein the elastically displaceable member is disposed between an end surface of the bearing and a surface of the housing which confronts this end surface or wherein a recess imparting elasticity is formed on a surface of the elastically displaceable member which confronts the end surface of the bearing on a side facing the scroll member.

3. A scroll fluid apparatus according to claim 1, wherein a discharge path is provided in a rotary shaft of the driven scroll, and further comprising an elastically displaceable discharging means, capable of displacement in the axial direction, provided between the housing of the driven scroll and a rotary shaft of the driven scroll.

4. A scroll fluid apparatus according to claim 1, wherein a loop-shaped dust seal housing is formed between outer peripheries of surfaces of which the wraps of the drive and driven scrolls are formed, a self-lubricating sealing member is disposed between the dust seal housing and the sliding surface of the outer peripheries of the drive and driven scroll plates, and the dust seal housing is disposed between the housings of the drive and driven scrolls.

5. A scroll fluid apparatus of a rotating drive/driven scroll type comprising:

a drive scroll and a driven scroll, the drive and driven scrolls including opposing scroll plates and being driven in a respective housing such that wraps thereof compress fluid and discharge compressed fluid to the outside, a scroll adjustment mechanism for adjusting engagement between the wraps and the opposing scroll plates, a scroll mounting member, which rotates together with the driven scroll, disposed on the driven scroll, and a bearing fitted to the outer periphery of the scroll mounting member and the outer periphery of the bearing being secured to the housing of the driven scroll so that the scroll mounting member rotates together with the driven scroll, wherein the housing of the driven scroll has a bearing retainer which urges the bearing against the housing in a thrust direction, and wherein the housing of the driven scroll is disposed between the bearing retainer and the rear surface of the driven scroll plate and is provided with an elastically displaceable member such that urging the bearing against the housing of the driven scroll elastically displaces the member in the thrust direction, and the driven scroll is made adjustable in the thrust direction.

6. A scroll fluid apparatus according to claim 5, wherein the elastically displaceable member is disposed between an end surface of the bearing and a surface of the housing which confronts this end surface or wherein a recess imparting elasticity is formed on a surface of the elastically displaceable member which confronts the end surface of the bearing on a side facing the scroll member.

7. A scroll fluid apparatus according to claim 5, wherein a discharge path is provided in a rotary shaft of the driven scroll, and further comprising an elastically displaceable discharging means, capable of displacement in the axial direction, provided between the housing of the driven scroll and a rotary shaft of the driven scroll.

8. A scroll fluid apparatus according to claim 5, wherein a loop-shaped dust seal housing is formed between outer peripheries of surfaces of which the wraps of the drive and driven scrolls are formed, a self-lubricating sealing member is disposed between the dust seal housing and the sliding surface of the outer peripheries of the drive and driven scrolls, and the dust seal housing is disposed between the housings of the drive and driven scrolls.

9. A scroll fluid apparatus of a rotating drive/driven scroll type comprising:

a drive scroll and a driven scroll, the scrolls including opposing scroll plates and being driven in a respective housing such that wraps thereof compress fluid and discharge compressed fluid to the outside, a scroll adjustment mechanism for adjusting engagement between the wraps and the opposing scroll plates, a fan blade formed on the rear surface of at least one of the opposing scroll plates, a scroll mounting member, secured to a rotary shaft, disposed between the drive scroll and the housing and rotating together with the rotary shaft and the drive scroll, the scroll mounting member having opening holes for feeding in cooling air such that the fan blade rotates along with the rotation of the drive scroll and conveys the cooling air to the outside from opening holes formed at the outer periphery of the housing, a bearing fitted between the housing and the scroll mounting member which supports the rotary shaft of the drive scroll, a deformable member on the housing adjacent to the bearing, and a bearing retainer which holds the bearing and which is mounted so that, by pushing the bearing against the deformable member on the housing, the drive scroll is made adjustable in the thrust direction.

10. A scroll fluid apparatus according to claim 9, wherein a loop-shaped dust seal housing is formed between outer peripheries of surfaces of which the wraps of the drive and driven scrolls are formed, a self-lubricating sealing member is disposed between the dust seal housing and the sliding surface of the outer peripheries of the drive and driven scroll plates, and the dust seal housing is disposed between the housings of the drive and driven scrolls.

11. A scroll fluid apparatus of a rotating drive/driven scroll type comprising:

a drive scroll and a driven scroll, the scrolls including opposing scroll plates and being driven in a respective housing such that wraps thereof compress fluid and discharge compressed fluid to the outside, a scroll adjustment mechanism for adjusting engagement between the wraps and the opposing scroll plates, a fan blade formed on the rear surface of at least one of the opposing scroll plates, a scroll mounting member, secured to a rotary shaft of the driven scroll which rotates along with the driven scroll, disposed between the driven scroll and the housing and rotating together with the rotary shaft and the driven scroll, the scroll mounting member having opening holes for feeding in cooling air such that the fan blade rotates along with the rotation of the driven scroll and conveys the cooling air to the outside from opening holes formed at the outer periphery of the housing, a bearing fitted between the housing and the scroll mounting member which supports the rotary shaft of the driven scroll, a deformable member on the housing adjacent to the bearing, and a bearing retainer which holds the bearing and which is mounted so that, by pushing the bearing against the deformable member on the housing, the driven scroll is made adjustable in the thrust direction.

12. A scroll fluid apparatus according to claim 11, wherein a loop-shaped dust seal housing is formed between outer peripheries of surfaces of which the wraps of the drive and driven scrolls are formed, a self-lubricating sealing member is disposed between the dust seal housing and the sliding surface of the outer peripheries of the drive and driven scroll plates, and the dust seal housing is disposed between the housing of the drive and driven scrolls.

* * * * *